US006860675B2

(12) United States Patent
Rose

(10) Patent No.: US 6,860,675 B2
(45) Date of Patent: Mar. 1, 2005

(54) METHOD AND APPARATUS FOR FINISHING CONCRETE

(76) Inventor: Lawrence K. Rose, 10455 N. Camino de la Tierra, Tucson, AZ (US) 85742

( * ) Notice: Subject to any disclaimer, the term of this patent is extended or adjusted under 35 U.S.C. 154(b) by 0 days.

(21) Appl. No.: 10/315,634

(22) Filed: Dec. 10, 2002

(65) Prior Publication Data

US 2004/0109728 A1 Jun. 10, 2004

(51) Int. Cl.[7] ..... E01C 19/22
(52) U.S. Cl. ..... 404/112
(58) Field of Search ..... 404/112

(56) References Cited

U.S. PATENT DOCUMENTS 2,198,929 A * 4/1940 Whiteman ..... 404/112
4,198,178 A * 4/1980 Carlstrom et al. ..... 404/112
4,312,603 A * 1/1982 Whiteman, Jr. ..... 404/112
4,629,359 A * 12/1986 Sengupta ..... 404/112
4,673,311 A * 6/1987 Whiteman, Jr. ..... 404/112
4,702,641 A * 10/1987 Naser et al. ..... 404/97
4,740,348 A * 4/1988 Rose ..... 264/296
4,838,820 A * 6/1989 Boda et al. ..... 440/87
5,096,330 A * 3/1992 Artzberger ..... 404/97
5,147,146 A * 9/1992 Harding, Jr. ..... 404/97
5,351,403 A * 10/1994 Becker et al. ..... 30/276
5,405,216 A * 4/1995 Allen et al. ..... 404/112
5,584,598 A * 12/1996 Watanabe et al. ..... 404/112
5,803,657 A * 9/1998 Hodgson ..... 404/112
5,993,109 A * 11/1999 Motl et al. ..... 404/112

* cited by examiner

*Primary Examiner*—Gary S. Hartmann
(74) *Attorney, Agent, or Firm*—Tod R. Nissle, P.C.

(57) ABSTRACT

A power trowel is provided for finishing concrete. The trowel can be used to finish concrete at different stages of hardening. The handle of the trowel is rotated both to adjust the speed of rotation of the trowel blades and the cant of the trowel blades.

1 Claim, 8 Drawing Sheets

METHOD AND APPARATUS FOR FINISHING CONCRETE

CROSS REFERENCE TO RELATED APPLICATIONS

N/A.

STATEMENT REGARDING FEDERALLY SPONSORED RESEARCH OR DEVELOPMENT

N/A.

INCORPORATION-BY-REFERENCE OF MATERIAL SUBMITTED ON A COMPACT DISC (See 37 CFR 1.52(e)(5) and MPEP 608.05

N/A.

BACKGROUND OF THE INVENTION (1) Field of the Invention

This invention relates to a method and apparatus for finishing freshly poured concrete.

More particularly, the invention relates to a concrete finishing method in which a power trowel floats on the liquid-particulate surface of wet concrete to produce a smooth, level surface finish prior to the concrete's hardening.

In another respect, the invention relates to a method for finishing freshly poured concrete in which a power trowel is provided with blades which can be canted during the finishing of concrete so the power trowel can be adapted for finishing concrete at different stages of hardening.

(2) Description of Related Art Including Information Disclosed under 37 CFR 1.97 and 1.98.

My U.S. Pat. No. 4,740,348 describes a power trowel for finishing concrete. The power trowel is light weight, and includes a throttle controlled by rotating the handle. While the power trowel set forth in U.S. Pat. No. 4,740,348 is, due to its light weight, especially useful, the power trowel is more difficult to use when concrete becomes stiff as it dries and sets. One way to compensate for the hardening of concrete is to alter the cant of the blades on the power trowel. In conventional trowels, this is accomplished by stopping the trowel and manually adjusting the position of the blades. This procedure is time consuming and can be impractical, especially when the concrete is hardening rapidly.

Accordingly, it would be highly desirable to provide an improved method and apparatus for adapting a light weight power trowel of the type described in U.S. Pat. No. 4,740,348 to permit the ready adjustment of the cant of the blades in order to permit the trowel to be used continuously while freshly poured concrete hardens.

Therefore, it is a principal object of the invention to provide an improved power trowel for finishing freshly poured concrete.

Another object of the invention is to provide a method and apparatus for adjusting the blades of a power trowel simultaneously with operating the power trowel to finish concrete.

BRIEF DESCRIPTION OF THE SEVERAL VIEWS OF THE DRAWING(S)

These and other, further and more specific objects and advantages of the invention will be apparent from the following detailed description of the invention, taken in conjunction with the drawings, in which.

BRIEF DESCRIPTION OF THE INVENTION

Figure 1:
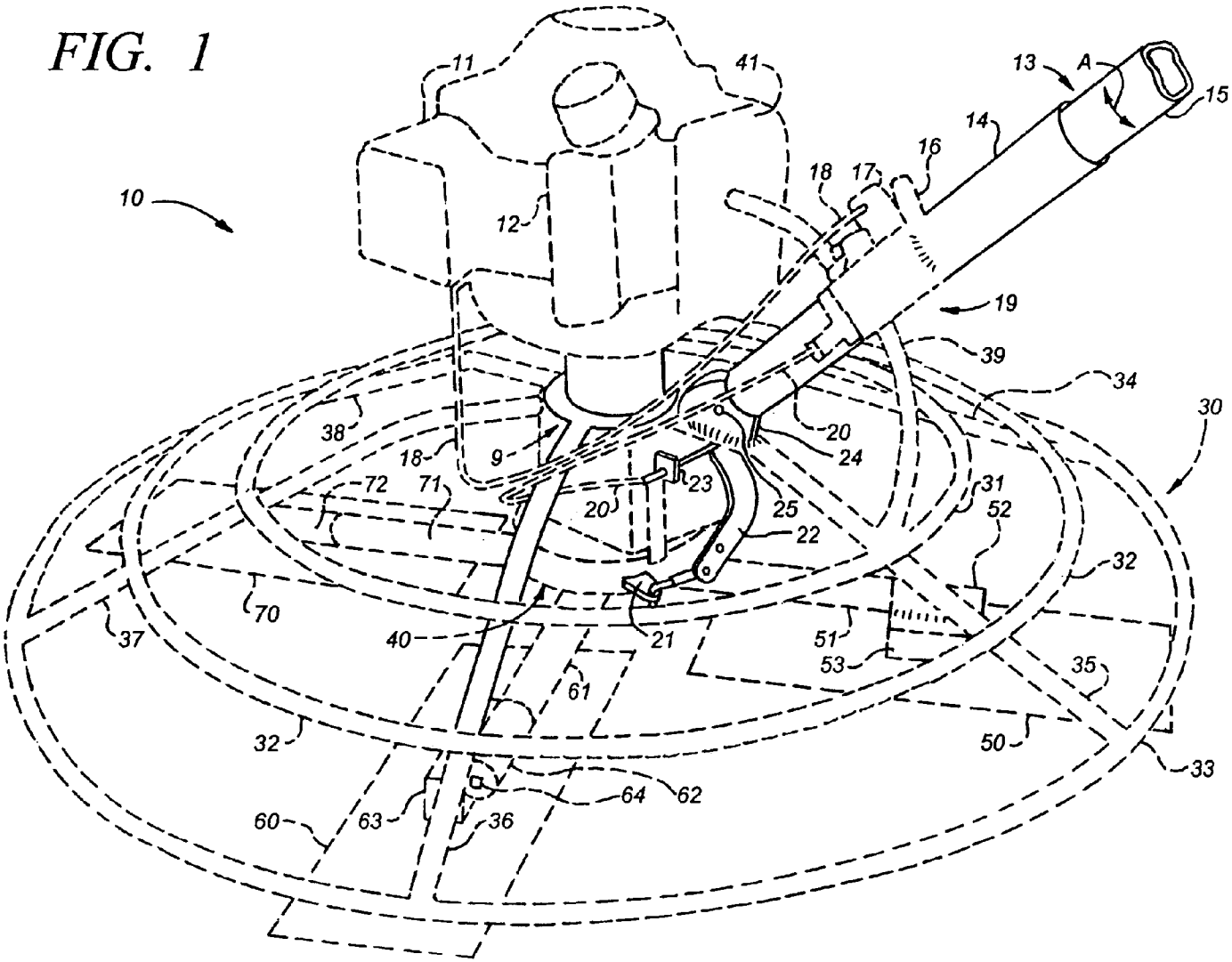
FIG. 1 is perspective view illustrating a power trowel constructed in accordance with the principles of the invention.

Briefly, in accordance with my invention, I provide an improved power trowel including a frame including a hub; a rotatable handle having a distal end and having a proximate end attached to the frame; a plurality of spaced apart blades pivotally mounted on and radially extending from the hub, each of the blades having a lower surface area; a transmission assembly mounted on the frame and operatively associated with the blades to pivot and alter the cant of the blades; a cable for activating the transmission assembly to pivot and alter the cant of the blades; a control assembly interconnecting the cable and the handle such that when the handle is rotated, the control assembly displaces the cable to activate the transmission assembly and pivot and alter the cant of the blades; and, an engine mounted on the frame and operatively associated with and rotating the hub.

In another embodiment of the invention, I provide a power trowel including a frame including a hub; a rotatable handle having a distal end and having a proximate end attached to the frame; a plurality of spaced apart blades pivotally mounted on and radially extending from the hub, each of the blades having a lower surface area; a transmission assembly mounted on the frame and operatively associated with the blades to pivot and alter the cant of the blades; a cable for activating the transmission assembly to pivot and alter the cant of the blades; a control assembly interconnecting the cable and the handle such that when the handle is rotated in a first direction, the control assembly displaces the cable to activate the transmission assembly and pivot and alter the cant of the blades; an engine mounted on the frame, having a throttle, and operatively associated with and rotating the shaft; a cable interconnecting the throttle and the handle such that when the handle is rotated in a direction opposite the first direction the cable is displaced and the throttle is adjusted.

In a further embodiment of the invention, I provide an improved method for finishing poured concrete to produce a smooth surface finish on the concrete. The improved method includes the steps of screeding a surface of the poured concrete to preliminarily level the surface of the concrete; moving a bull float over the surface; and, making a pass over the surface with a power trowel. The power trowel includes a frame including a hub; a rotatable handle having a distal end and having a proximate end attached to said frame; a plurality of spaced apart blades pivotally mounted on and radially extending from the hub, each of said blades having a lower surface area; a transmission assembly mounted on the frame and operatively associated with the blades to pivot and alter the cant of the blades; a cable for activating the transmission assembly to pivot and alter the cant of the blades; a control assembly interconnecting the cable and the handle such that when the handle is rotated, the control assembly displaces the cable to activate the transmission assembly and pivot and alter the cant of the blades; and, an engine mounted on the frame and operatively associated with and rotating the hub. The method also includes the step of rotating, while the engine is running and the power trowel is on the concrete, the handle to displace the cable, activate the transmission assembly, and alter the cant of the blades.

DETAILED DESCRIPTION OF THE INVENTION

Figure 2:
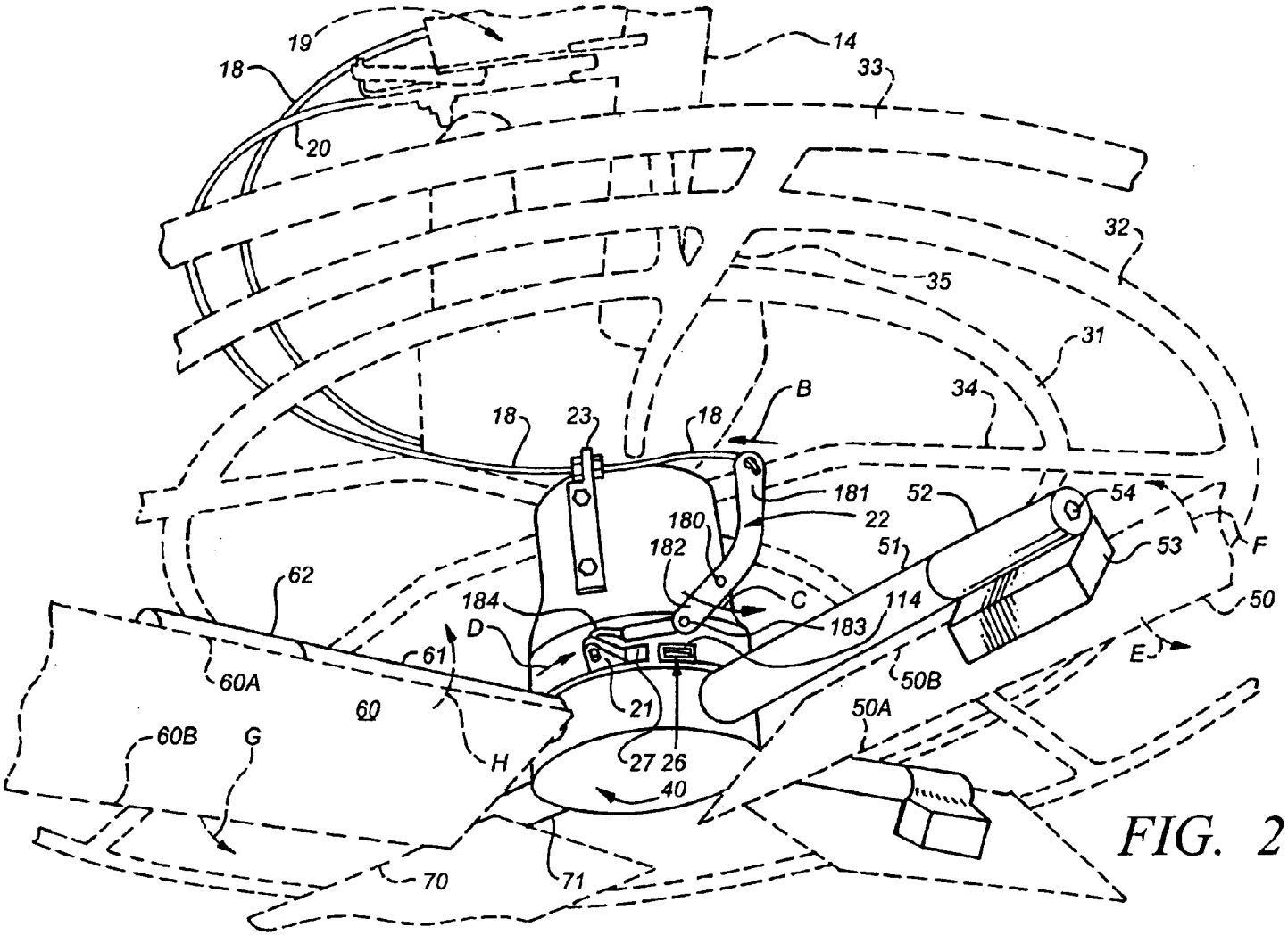
FIG. 2 is a bottom perspective view of the power trowel of FIG. 1 illustrating further construction details thereof.

Turning now to the drawings, which depict the presently preferred embodiments of the invention for the purpose of illustrating the practice thereof and not by way of limitation of the scope of the invention, and in which like reference characters refer to corresponding elements throughout the several views, FIGS. 1 and 2 illustrate a power trowel constructed in accordance with the invention and generally indicated by reference character 10. Trowel 10 includes a frame 9. Engine 11, fuel tank 12, and plate 41 are mounted on frame 9. A drive shaft 140 (FIG. 5) extends from engine 11, through an aperture in frame 9, and to hub 40. When engine 11 is running, engine 11 turns shaft 140 and hub 40. Frame 9 can include a safety cage fabricated from tubing made from aluminum or another material. The cage includes concentric circular tubes 31, 32, 33 welded to radial arms 34, 35, 36, 37, 38. Arcuate tube 39 extends from plate 41 to arm 35.

Figure 3:
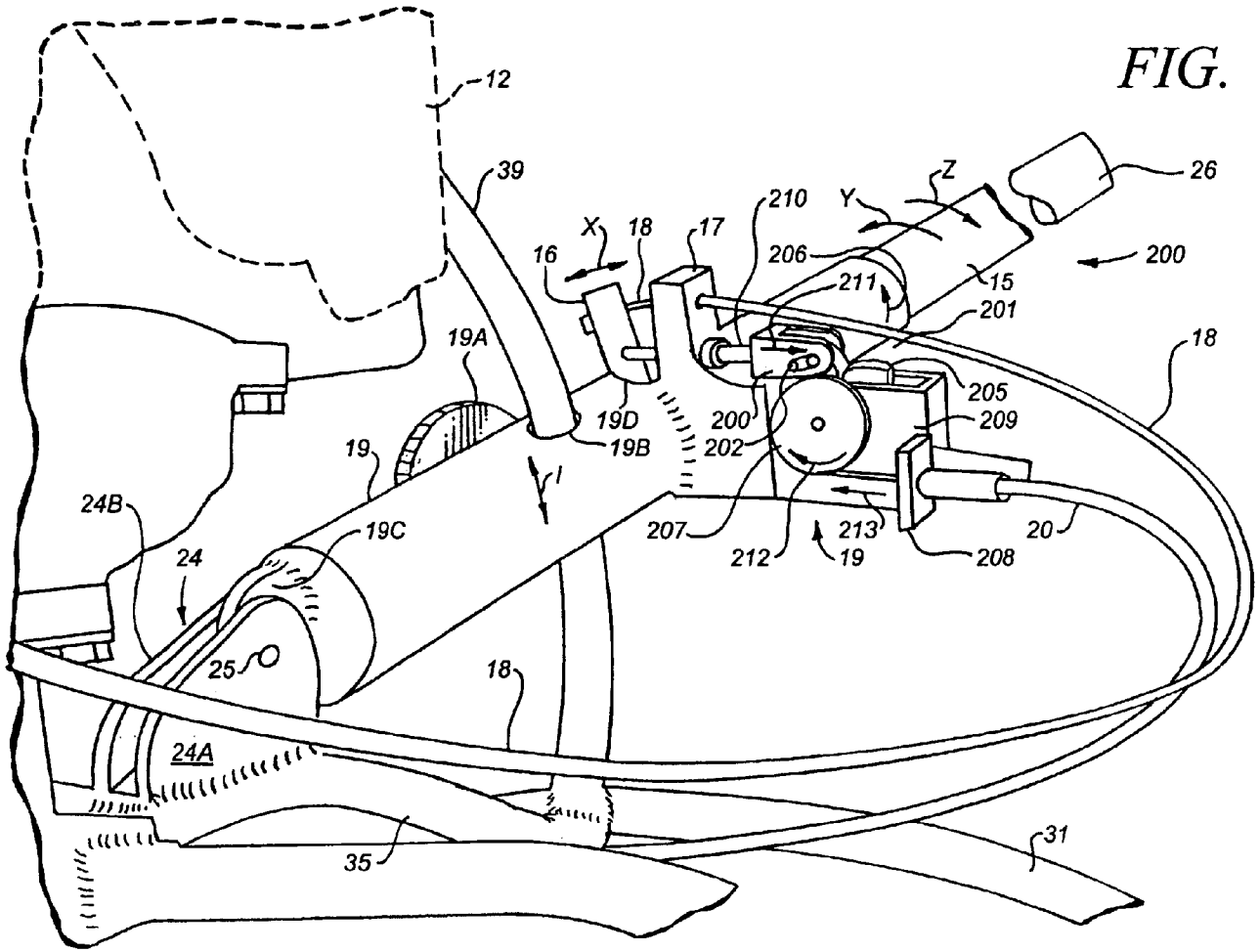
FIG. 3 is a perspective view of the power trowel of FIG. 1 illustrating further construction details thereof.

As is illustrated in FIG. 3, tube 39 extends through an arcuate opening 19B (FIG. 3) formed in sleeve 19 and functions as a guide for sleeve 19 along which opening 19B travels when sleeve 19 (and the handle 13 in sleeve 19) is pivoted about pivot point 25 in the direction of arrows 1. Flange 19C at the end of hollow sleeve 19 is pivotally attached by pin 25 intermediate receiving parallel flange pair 24A and 24B.

The proximate end 15 of the handle 13 is rotatably received in sleeve 19. Cylindrical foot 16 extends through opening 19D in sleeve 19 and is fixedly attached to end 15. Rotating the handle 13 in the directions indicated by arrows Y and Z causes foot 16 to rotate side-to-side simultaneously in opening 19D, as indicated by arrows X. One end of cable 18 slidably passes through upstanding member 17 and is fixedly connected to foot 16. The other end of cable 18 is connected to the throttle (not visible) of motor 11. The handle 13 has an "at rest" or neutral position in which member 16 is centered in elongate aperture 19D. When the distal end 26 (FIG. 3) of the handle is manually rotated in the direction of arrow Y, member 16 is displaced simultaneously in the direction of arrow Y, pulls on cable 18, and displaces the throttle to increase the flow of fuel to the engine and to increase the RPM of drive shaft 140. When the distal end 26 of the handle is manually rotated in the direction of arrow Z back to the "at rest" or neutral position of the handle, the throttle returns to idle or to a pre-set position in which the drive shaft 140 rotates at a lower RPM. In contrast, when the distal end 26 of the handle is manually rotated from its "at rest" or neutral position in the direction of arrow Z, shaft 210 and foot 200 move in the direction of arrow 211. Shaft 210 interconnects foot 200 and foot 16 and slidably extends through an opening formed in member 17. When the handle is manually rotated from its "at rest" or neutral position in the direction of arrow Y, shaft 210 pulls foot 200 in a direction opposite that of arrow 211. When foot 200 moves in this opposite direction, pawl 201 does not engage or turn toothed gear wheel 204. When, however, foot 200 is moved in the direction of arrow 211 by rotating the handle in the direction of arrow Z from the handle's neutral position, pawl 201 engages and turns wheel 204. Since pulley 207 is connected to toothed wheel 204, pulley 207 turns simultaneously with wheel 204. Pulley 207 rotates in the direction indicated by arrow 212, pulling cable 20 in the direction of arrow 213. When cable 20 is pulled in the direction of arrow 213, lever arm 22 pivots about pin 180 and the upper end 181 of lever arm 22 (FIG. 2) is displaced in the direction of arrow B. When end 181 is displaced in the direction of arrow B, lower end 182 is displaced in the direction of arrow C. Displacing end 182 in the direction of arrow C pulls hook 184 and tab 21 in the direction of arrow D. As will be described below, pulling tab 21 in the direction of arrow D activates a transmission assembly, causing the blades 50, 60, 70, 80 to rotate to alter the cant of the blades.

Figure 8:
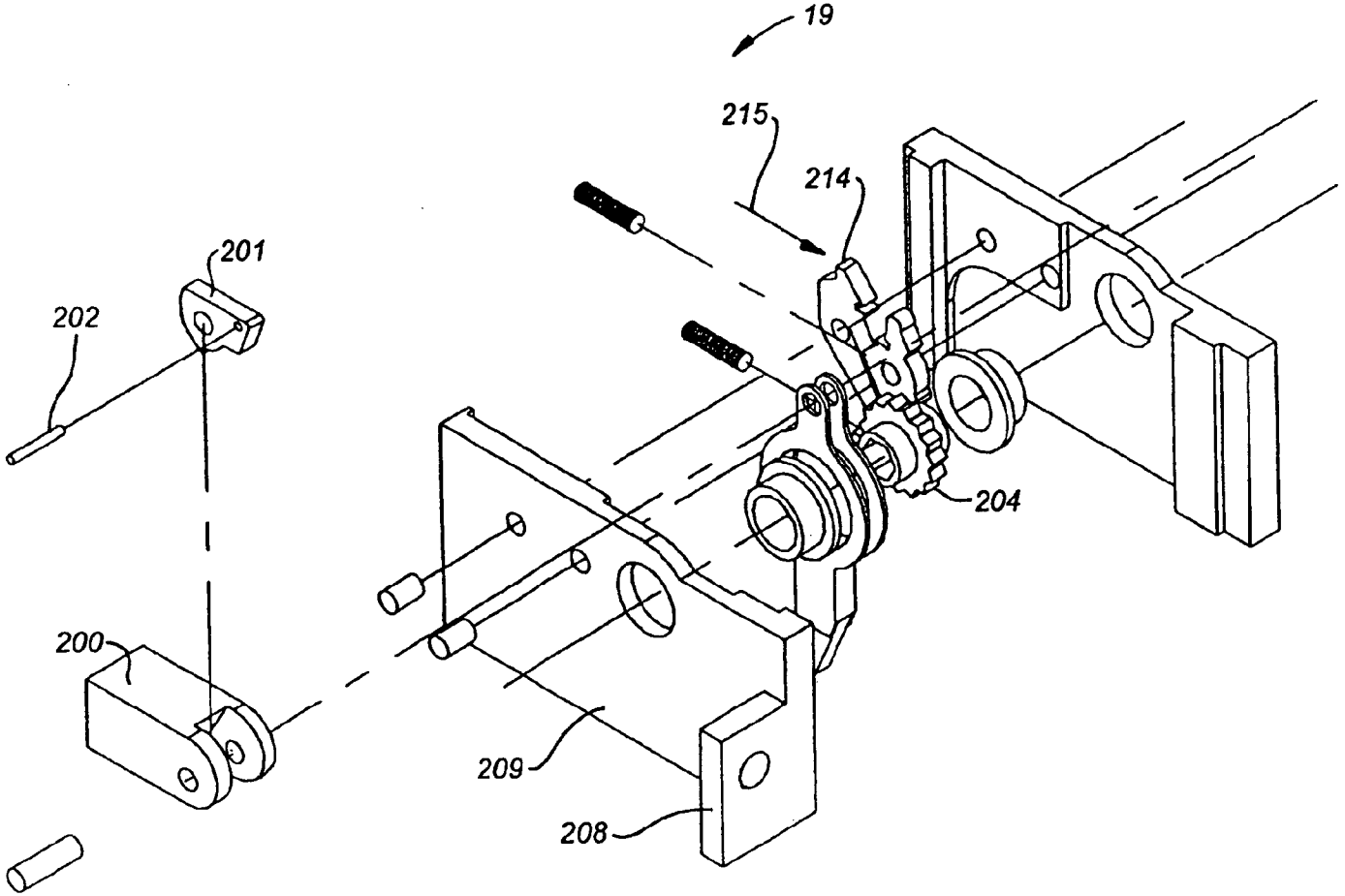
FIG. 8 is an exploded perspective view of the ratchet assembly used in the power trowel of the invention to adjust the cant of the power trowel blades; and, FIG. 9 is a perspective view illustrating the functioning of the handle used on the power trowel of the invention.

Pin 202 is provided on pawl 201 so that when foot 200 is displaced a sufficient distance in the direction of arrow 211, pin 202 rides upwardly on cam surface 205, disengaging pawl 202 from gear wheel 204. This prevents tab 21 from being displaced too far in the direction of arrow D (FIG. 2). Displacing lever arm 214 (FIG. 8) in the direction of arrow 215 functions to release the ratchet assembly such that wheel 204 can free-wheel and the force of gravity acting on the weight of the power trowel will, when the power trowel is setting on the ground, cause blades 50, 60, 70, 80 to rotate back to their original position where blades 50, 60, 70, 80 are more nearly parallel to the ground and are not as severely canted with respect to the ground. Ratchet assembly 19 includes side 209.

As can be seen, the function of the ratchet assembly 19 is, when the handle is rotated, to activate the transmission assembly in the power trowel to cause the cant of blades 50, 60, 70, 80 to be increased. While the ratchet assembly 19 and transmission assembly disclosed herein are presently preferred, any desired ratchet assembly construction and transmission assembly construction can be operatively associated with the rotation of handle and used to accomplish this function. If desired, a mechanism other than a ratchet assembly can be utilized.

Figure 4:
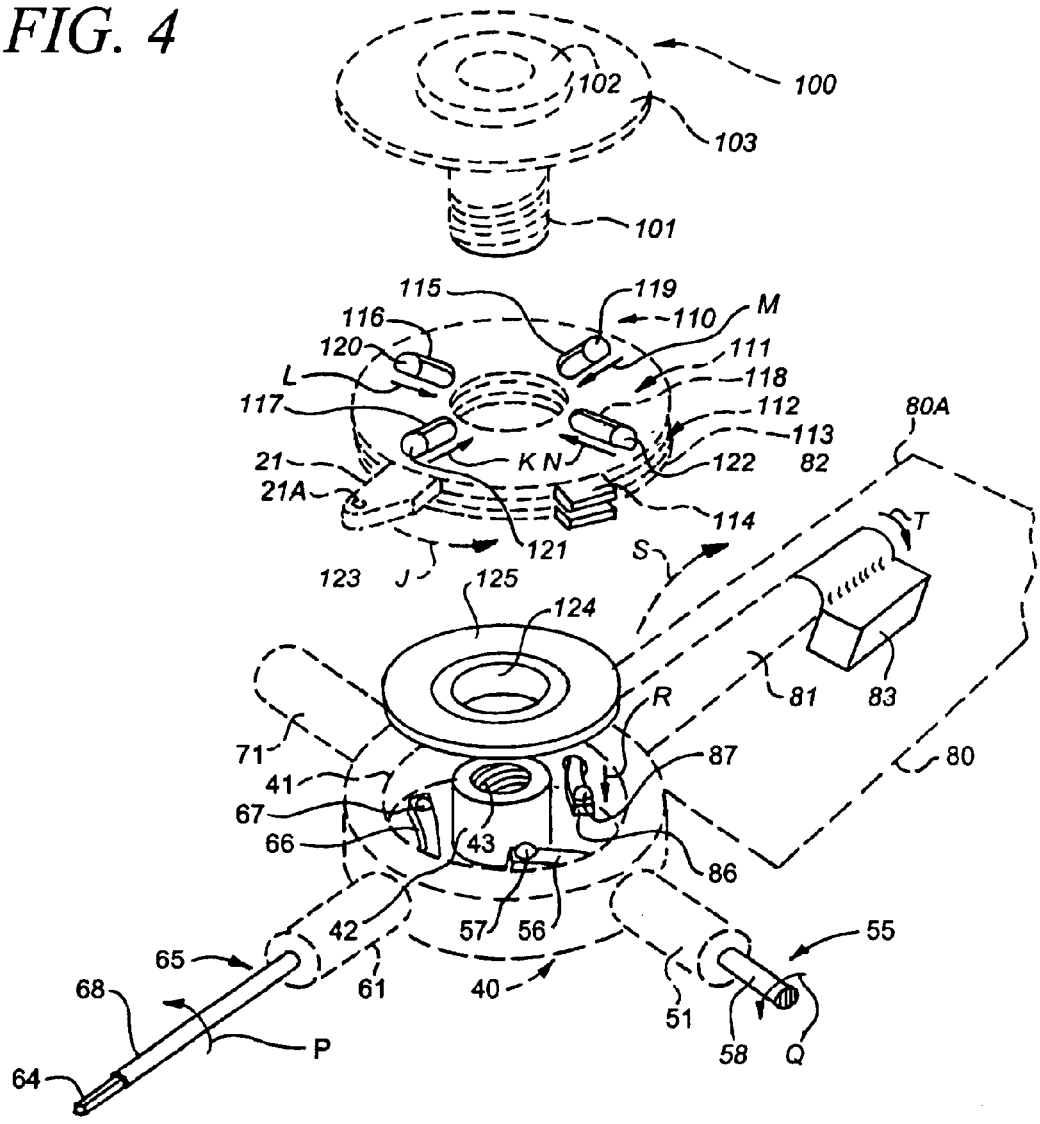
FIG. 4 is an exploded perspective view illustrating the hub assembly of the power trowel of FIG. 1.

In FIGS. 1, 2, and 4 each blade 50, 60, 70, 80 is fixedly attached to an orthogonal block 53, 63, 73, 83, respectively. Each blade is of equal shape and dimension, although this need not be the case. Each block is of equal shape and dimension, although this need not be the case. Each block is fixedly secured to a hollow cylindrical member 52, 62, 72, 82, respectively. Each member 52, 62, 72, 82 is of equal shape and dimension, although this need not be the case. Each member 52, 62, 72, 82 includes an orthogonal opening formed through its center. This orthogonal opening receives the orthogonal end of a control arm. For example, member 62 receives orthogonal end 64 on distal end 68 of arm 65. End 64 and the opening that receives and conforms to end 64 prevent arm 65 from rotating in member 62 and, consequently, cause member 62 and arm 65 to rotate simultaneously.

Each control arm mounted in its associated member 52, 62, 72, 82 is of equal shape and dimension, although this need not be the case. For example, arm 55 has a shape and dimension equal to that of arm 65. Arms 75 and 85 are not visible in the drawings and extend through hollow members 72 and 82 in the same manner that arms 55 and 65 extend through members 52 and 62, respectively.

The proximate end 56, 66, 76 (not visible), 86 of each arm 55, 65, 75, 85 is positioned inside hub 40. Each arm 55, 65, 75, 85 rotatably extends through a hollow cylindrical support member 51, 61, 71, 81, respectively. Each support member 51, 61, 71, 81 is fixedly secured to and outwardly depends from hub 40. A semi-spherical bearing surface 57, 67, 77 (not visible), 87 is fixedly secured to the top of proximate ends 56, 66, 76, 86, respectively. Ends 56, 66, 76, 86 each extend inwardly, and if desired upwardly, from inner cylindrical wall 41 of hub 40 so that when a bearing surface 57, 67, 77, 87 and its associated end 56, 66, 76, 86, respectively, is downwardly pivoted in the direction of arrow V in FIG. 5, arm 55, 65, 75, 85, as the case may be, rotates in the manner indicated by arrows P and Q in FIG. 4. When an arm 55, 65, 75, 85 rotates, the blade 50, 60, 70, 80 mounted on the arm also rotates, increasing the cant of the blade with respect to the surface of concrete being finished. For example, when proximate end 86 and bearing surface 87 are downwardly pivoted through an arc in the direction indicated by arrow R in FIG. 4, member 82 and block 83 rotate or pivot simultaneously with the distal end of arm 85 in the direction indicated by arrow T, and edge 80A pivots upwardly through an arc in the direction indicated by arrow S. When edge 80A pivots upwardly, the cant of blade 80 is increased with respect to the surface of concrete being finished with the power trowel of the invention. Similarly, downwardly depressing arm 66 causes blade 60 to cant such that edge 60A moves upwardly in the direction of arrow H (FIG. 2) and edge 60B moves downwardly in the direction of arrow G. Downwardly depressing arm 56 causes blade 50 to cant such that edge 50A moves downwardly in the direction of arrow E and edge 50B moves upwardly in the direction of arrow F.

The transmission assembly that functions to displace arms 56, 66, 76, 86 is shown in more detail in FIGS. 4 to 7. The transmission assembly includes members 100 and 123; plates 111, 112, 113; circular race 127 with bearings 128 rotatably set therein; circular flat washer 130; and, ball bearings 119 to 122. Upper plate 111 is identical to lower plate 113. Member 100 includes neck 102, upper flat circular surface 103, lower conical surface 104, and externally threaded cylindrical surface 101. Member 123 includes upper conical surface 125 (opposed to conical surface 104 in FIG. 5), inner cylindrical surface 124 and outer cylindrical surface 124A. Surface 124 slides over outer cylindrical surface 42.

Figure 6:
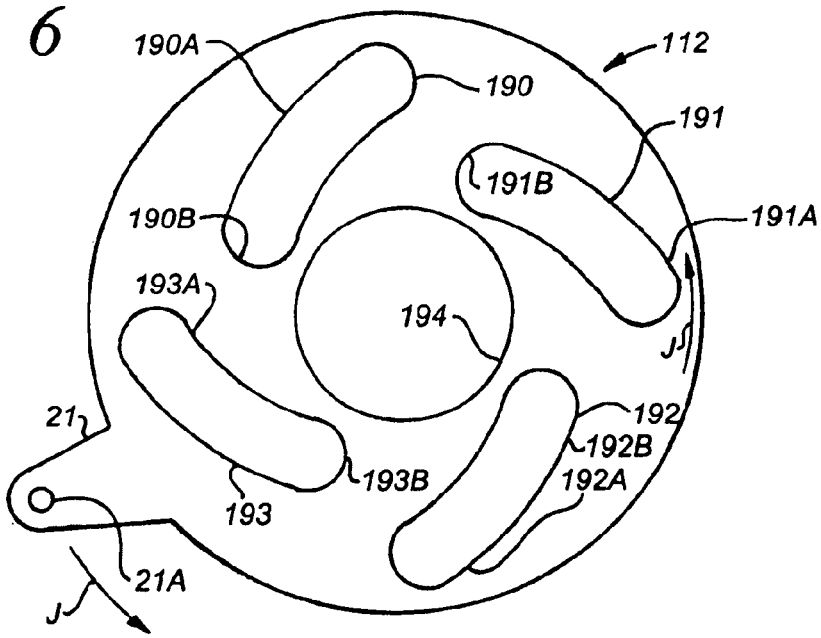
FIG. 6 is a bottom view of the intermediate ball bearing adjustment plate used in the hub assembly of FIGS. 5 and 6 to adjust the cant of the power trowel blades.

As shown in FIG. 6, plate 112 includes tab 21 with aperture 21A formed therethrough to receive hook 184. Plate 112 also includes arcuate openings 190 to 193 formed at equal intervals in plate 112. Each opening 190 to 193 extends completely through plate 112.

Figure 5:
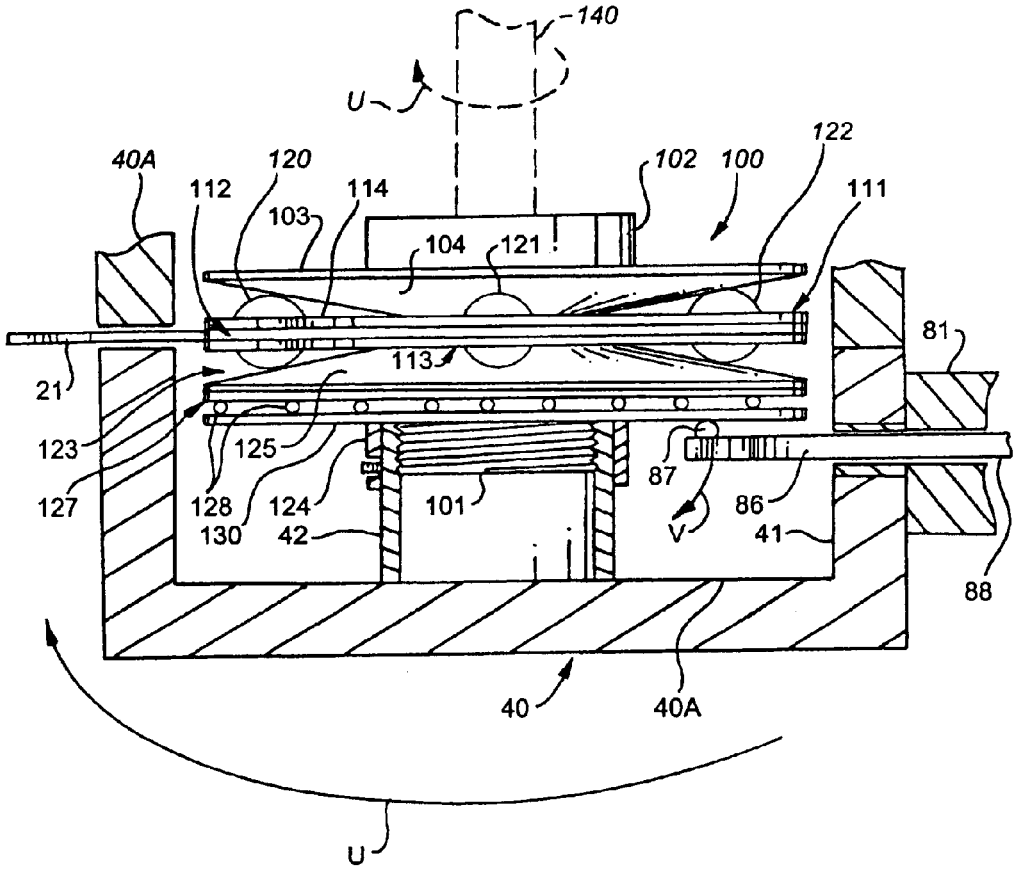
FIG. 5 is a section view of the hub assembly of FIG. 4 illustrating the mode of operation thereof.
Figure 7:
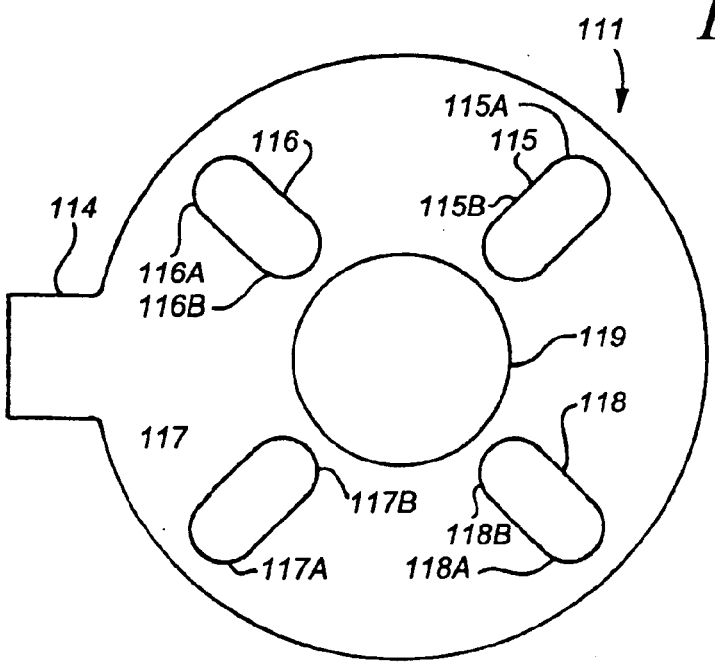
FIG. 7 is a top view of the top ball bearing adjustment plate used in the hub assembly of FIGS. 5 and 6, the top ball bearing adjustment plate being identical to the bottom ball bearing adjustment plate.

In FIG. 7, plate 111 (and therefore plate 113) includes tab 114 and includes radial grooves or openings 115 to 118 each extending completely through plate 111. Openings 115 to 118 are formed at equal intervals in plate 111. As shown in FIG. 5, tabs 114 of plates 111 and 113 in registration are stacked one on top of the other. In FIG. 2, the stacked tabs 114 are indicated by reference character 26 and extend through opening 114 formed in the frame 9. Since frame 9 is fixed during operation of the power trowel, tabs 114 remain in fixed position in opening 114, preventing plates 111 and 113 from rotating.

When tab 21 is at the "neutral" position shown in FIG. 2, blades 50, 60, 70, 80 are slightly canted from parallel with respect to the surface of the concrete being finished with the power trowel. In this "neutral" position, the blades are typically canted at a "preset" angle in the range of two degrees to ten degrees. When tab 21 is in the neutral position, ball bearings 119 to 122 are typically positioned near the outer ends 115A to 118A of the openings 115 to 118 in plate 111 (and plate 113). Plates 111 and 113 are positioned such that each opening in a plate 111 is in registration with an opening in the other plate 113. When tab 21 is in the neutral position, ball bearings 119 to 122 are also typically positioned near the outer ends 190A to 193A of the openings 190 to 193 in plate 112. When ratchet assembly 119 is operated by rotating the handle to displace hook 184—and therefore tab 21—in the direction of arrow D in FIG. 2 and arrow J in FIG. 4, tab 21 is displaced. When tab 21 is displaced, the remaining portion of plate 112 simultaneously rotates in the direction of arrow J. Rotating plate 112 in the direction of arrow J causes the ball bearings to move along openings 190 to 193 toward the inner ends 190B to 193B of said openings. When the ball bearings 119 to 122 move along openings 190 to 193 toward ends 190B to 193B, the bearings also simultaneously roll or slide or move along openings from outer ends 115B to 118B toward inner ends 115B to 118B. When bearings 119 to 122 move toward the inner ends of openings 190 to 192 and of openings 115 to 118, the bearings force sloped surface 125 (and washer 130) downwardly away from sloped surface 104 (FIG. 5). When sloped surface 125 (and member 123) are forced downwardly, surface 124 slides over surface 42, and race 127 and washer 130 are forced downwardly against bearing surfaces 57, 67, 77, 87 to displace downwardly proximate ends 56, 66, 76, 86 in the manner indicated by arrows V (FIG. 5) and R (FIG. 4) to increase the cant blades of 50, 60, 70, 80.

In FIG. 5, circular washer 130 rests on bearing surfaces 57, 67, 77, 87. Apertures 119, 194, and 124, along with similar apertures formed through race 127 and washer 130, permit plates 111 to 113, member 123, race 127, and washer 130 to slide up and down along the outer surface 42 of the hollow internally threaded 43 cylindrical member that depends upwardly from the floor 40A of hub 40. External threads 101 of member 100 turn into internally threaded 43 cylindrical surface. Member 100 is fixedly attached to drive shaft 140 and rotates simultaneously therewith when engine 11 is operating, as does hub 40. Plates 111 to 113 do not rotate with hub 40 and shaft 140. Members 123, 127 and washer 130 may rotate with hub 40, or, rotate at a slower speed due to the friction between bearings 119 to 122 and conical surface 125. The outer diameter of race 127 and washer 130 are presently, but not necessarily, equal to the outer diameters of plates 111 to 113.

In use, fresh concrete is poured and is screeded to preliminarily level the surface of the concrete. The concrete is then tamped to bring the fines to the surface. A bull float is moved over the surface of the wet concrete. The bull float ordinarily is fabricated from a material generally free of iron. The power trowel of the invention is then passed over the concrete by starting the engine 11 to rotate the blades and by placing the trowel 10 on the horizontally oriented surface of the concrete. The trowel is moved over the surface of the concrete by grasping the distal end 26 of the elongate generally straight, rigid handle and by pulling and pushing the handle 13 to move the trowel over the concrete. The throttle is increased, and the rpm of the blades 50, 60, 70, 80 increased, by manually turning the handle 13 in the direction of arrow Y away from the "at rest" or neutral position of the handle. The cant of blades 50, 60, 70, 80 is increased by turning the handle in the direction of arrow Z to activate ratchet assembly 19 to displace cable 20 and tab 21 to cause the transmission assembly to downwardly displace the proximate ends 56, 66, 76, 86 to cant blades 50, 60, 70, 80 in the manner earlier described.

Figure 9:
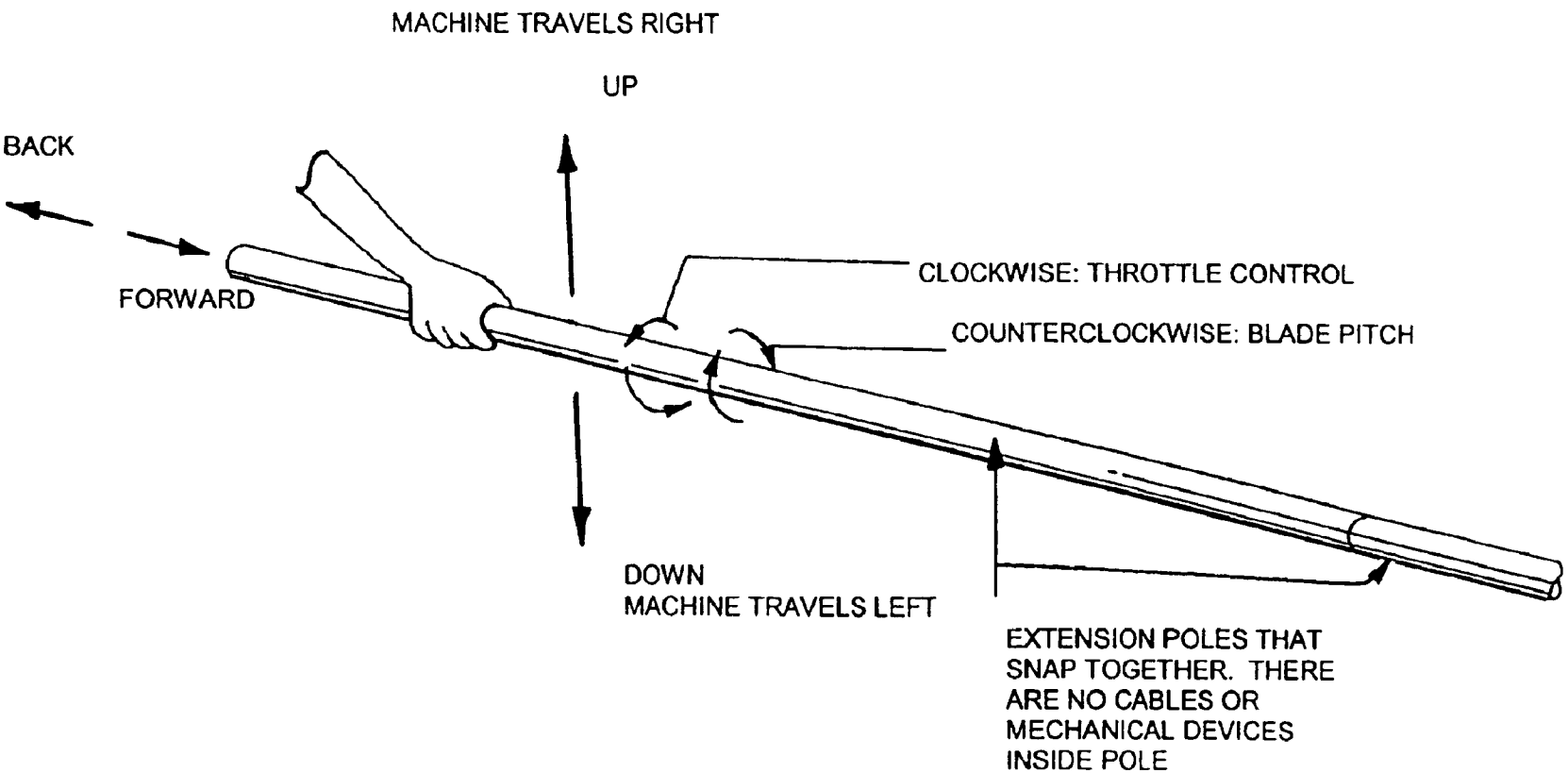

FIG. 9 further illustrates operation of handle 13.

Cables 18, 20 can, if desired, each be replaced with a linkage assembly.

The handle 13 can consist of a plurality of tube lengths that can telescope, can bolt together, or can otherwise be interconnected. In one preferred embodiment, an end of a cylindrical section of the handle 13 has a reduced diameter that slides into the larger diameter end of a receiving section. The reduced diameter end also is provided with a spring loaded ball bearing that snaps into an opening formed in the larger diameter end of the receiving section when the smaller diameter end slidably seats in the larger diameter end. The ball bearing prevents the smaller diameter end from rotating in the receiving larger diameter end of the receiving section.

Having described my invention in such terms as to enable those of skill in the art to make and practice it, and having described the presently preferred embodiments thereof.

I claim:

1. A power trowel including (a) a frame including a hub;

(b) a pole having (i) a distal end shaped to be grasped as a handle, (ii) a proximate end attached to said frame, (iii) a longitudinal axis extending from said distal end to said proximate end, said pole rotatable along its entire length about said longitudinal axis;

(c) a plurality of spaced apart blades pivotally mounted on and radially extending from said hub, each of said blades having a lower surface area;

(d) a transmission assembly mounted on said frame and operatively associated with said blades to pivot and alter the cant of said blades;

(e) a first cable for activating said transmission assembly to pivot and alter the cant of said blades;

(f) a control assembly interconnecting said proximate end of said pole and said cable, said control assembly including a component connected to and extending outwardly from said proximate end of said pole at an angle to said longitudinal axis such that when said handle is rotated in a selected direction, said component is laterally displaced with respect to said longitudinal axis and activates said control assembly to displace said cable to activate said transmission assembly and pivot and alter the cant of said blades;

(g) an engine mounted on said frame, having a throttle, and operatively associated with and rotating said hub; and, (h) a second cable interconnecting said throttle and said pole and including an end attached to said proximate end of said pole such that when said pole is rotated about said longitudinal axis in a direction opposite said selected direction, said end of said second cable is laterally displaced with respect to said longitudinal axis and said second cable is displaced to adjust said throttle.

* * * * *